US006337475B1

(12) United States Patent
Migliorini

(10) Patent No.: US 6,337,475 B1
(45) Date of Patent: Jan. 8, 2002

(54) THERMAL SILHOUETTE TARGET AND ZEROING TECHNIQUE

(75) Inventor: Robert L. Migliorini, Woodbridge, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/512,026

(22) Filed: Feb. 24, 2000

(51) Int. Cl.[7] ..... H01L 27/00
(52) U.S. Cl. ..... 250/208.1; 273/348.1
(58) Field of Search ..... 250/208.1, 203.1, 250/221, 559.12; 382/153, 154; 273/348.1

(56) References Cited

U.S. PATENT DOCUMENTS 4,405,132 A * 9/1983 Thalmann ..... 273/348.1

* cited by examiner

*Primary Examiner*—Que T. Le
(74) *Attorney, Agent, or Firm*—Milton W. Lee; John E. Holford; Alain L. Bashore

(57) ABSTRACT

A thermal silhouette target including a high emissivity surface, a conductive layer, a heating coil, an insulative layer and a direct voltage source. A thermal zeroing silhouette target device further includes a mask with a zeroing grid and a pair of contacts for electrical connection to a direct voltage current source.

4 Claims, 3 Drawing Sheets

THERMAL SILHOUETTE TARGET AND ZEROING TECHNIQUE

BACKGROUND OF THE INVENTION

1. Field of the Invention

The present invention generally relates to thermal silhouette targets and more specifically, to a multi-layer electrically heated thermal silhouette target for 25 meter zeroing of a weapon mounted Thermal Imaging Sensor.

2. Description of Prior Art

Thermal imaging Sensors (TIS) must be zeroed before being used on a weapon. The current method to zero a TIS utilizes a large heated E-Type silhouette target along with attaching a modified non-thermal 25 meter zeroing target. The target provides temperature difference by either having a hole cut into it (air temperature difference), or pasting a foil sticker (reflective temperature difference) on it. The heated E-Type silhouette must use a 110 VAC or a large 12/24 Vdc power source.

If a hole is used, the E-Type target will eventually heat up the paper and cause the hole to disappear a seen by the TIS because of an eventual lack of temperature difference. If the foil sticker is used, the precise angle the target presented to the soldier becomes critical, since if the target is not perfectly aligned, the soldier will not be able to spot the target.

While the prior art has reported using thermal silhouette targets none have established a basis for a specific technique and target that is dedicated to the task of resolving the particular problem at hand. What is needed in this instance is a self contained thermal silhouette target device and technique for 25 meter zeroing of a thermal imaging sensor that is substantially insensitive to angular adjustments to the target.

SUMMARY OF THE INVENTION

It is therefore one object of the invention to provide a thermal silhouette target device and technique that for 25 meter zeroing of a thermal imaging sensor is substantially insensitive to angular adjustments to the target.

There is disclosed a thermal silhouette target for viewing by a thermal imaging sensor (TIS). A high emissivity surface adjoins a conductive layer which when heated by a heating coil allows the high emissivity surface to be seen as a silhouette by a TIS. An insulative layer with the predetermined silhouette adjoins the heating coil and said conductive layer. A direct voltage source is removably coupled to lead wires of the heating coil. The TIS views the silhouette as substantially insensitive to angular adjustments of the thermal silhouette target to the TIS.

A thermal zeroing silhouette target device for zeroing a thermal imaging sensor (TIS) mounted on a weapon also utilizes the thermal silhouette target. A mask including a zeroing grid on its surface has centrally located thereon the thermal silhouette target with said lead wires protruding from the back surface of the mask. A pair of contacts on the mask allows for electrical connection to the direct voltage current source. The TIS views said silhouette as substantially insensitive to angular adjustments of said thermal silhouette target to the TIS so that after the mounted weapon is fired, groups of impact points can be measured regarding the zeroing grid.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
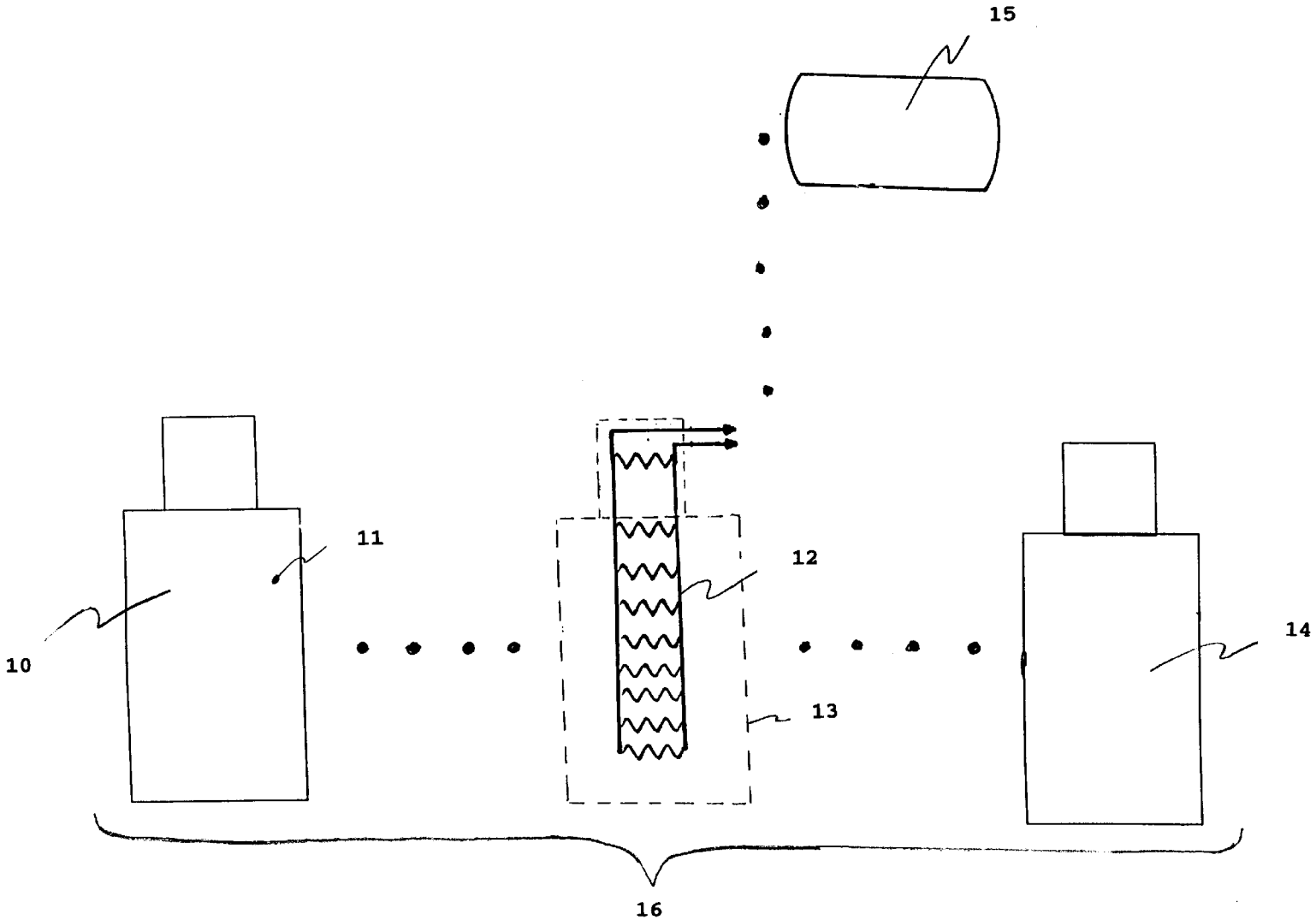
FIG. 1 is an exploded front view of the elements of the thermal silhouette target device of the present invention.

Referring now to the drawings, and more particularly to FIG. 1, there is shown an exploded front view of the elements of the thermal silhouette target device of the present invention with copper foil layer 10 with a silhouette shape. It is understood that the invention is not limited to a particular silhouette as the zeroing target. Front surface 11 of copper foil layer 10 is painted with high emissivity ultra-flat paint. Heating coil 12 is a shellac insulated copper wire that is attached to the back side of copper foil layer 10 in a general position relative to shape outline 13 as shown in FIG. 1. Layer 14 is a synthetic polymer film, such as MYLAR or acetate that is attached over heating coil 12. Zeroing target 16 is removably attached to a zeroing target background and voltage source 15 is removably attached to heating coil 12 prior to the zeroing process. Voltage source in the preferred embodiment is a 1.5 V dc standard battery, which may be external or attached on the back of the over-all target mask.

Figure 2:
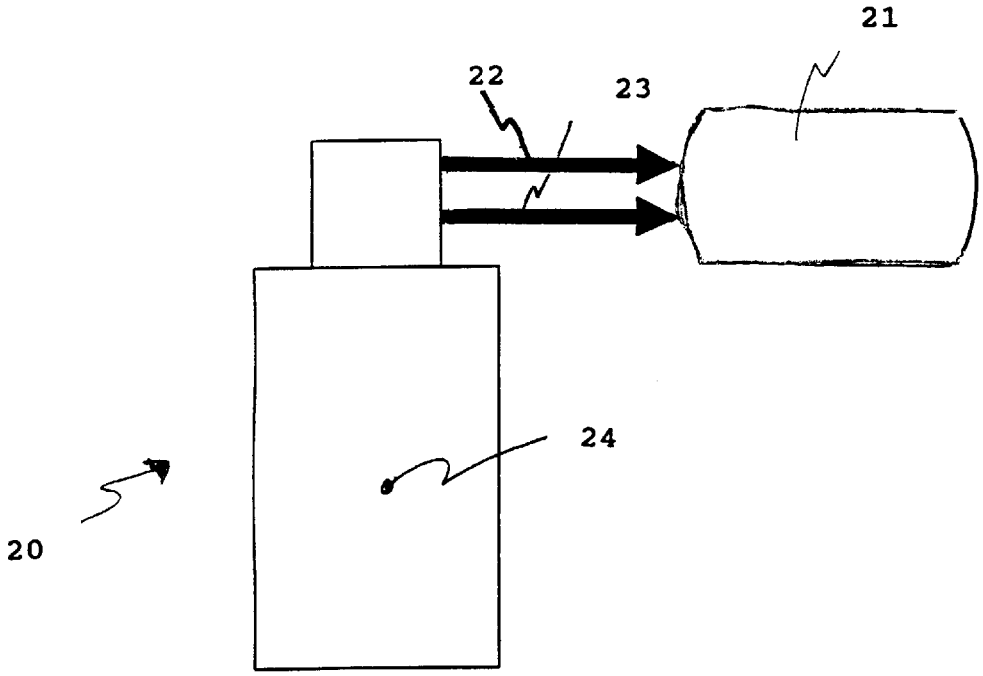
FIG. 2 is a front view of the thermal zeroing silhouette target device of the present invention.

FIG. 2 is a front view of the thermal zeroing silhouette target device 20 with all layers and voltage source 21 attached as a thermal silhouette target for 25 meter zeroing of a weapon mounted thermal imaging sensor. It is understood that lead wires 22 and 23 with removably attached voltage source 21 are usually positioned behind a zeroing target background. Front surface 24, once a voltage source is attached, would thus become an emissive surface as seen through a thermal imaging sensor and can function as a thermal silhouette.

The thermal target for the preferred embodiment can be shaped either as a body silhouette or as rectangular silhouette. The body silhouette is approximately 2×2 cm for a head and 5.5×4 cm for a body. The rectangular silhouette is a 4 cm×4 cm. The zeroing grid utilized in the preferred embodiment is a 25 meter zeroing grid with a size of 8.5 inch by 11 inch. A standard Alkaline 1.5 V dc Battery (size AA, C, or D cell) is utilized as the voltage source. The heating coil is shellac coated copper wire ranging from 30 to 40 Gauge. The Copper foil utilized has a thickness that can range from 0.001 to 0.006 inches. For ultra-flat black emissive paint, a Borden's paint #1602 was utilized. A MYLAR or any other poor-heat conductor film used behind the copper foil to prevent thermal conduction to other areas of the target. Thickness of the Mylar (or other film) can range from approximately 0.050 to 0.125 inches or greater.

Figure 3:
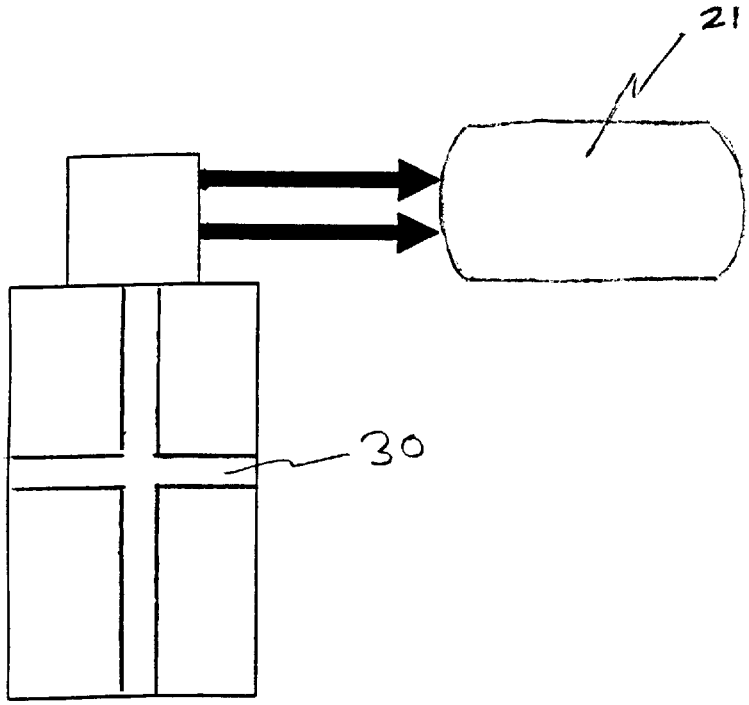
FIG. 3 is a front view of FIG. 2 with front reflective element.

FIG. 3 is a front view of FIG. 2 with front reflective element 30. Front reflective element 30 functions as a reticle or cross-hair by using a highly reflective foil taped to the front surface of the preferred embodiment. Since the front surface of the target (aim point) is heated and has a high emissivity, the foil reticle or cross-hair is seen without angular adjustments to the target and substantially insensitive to environmental conditions.

Figure 4:
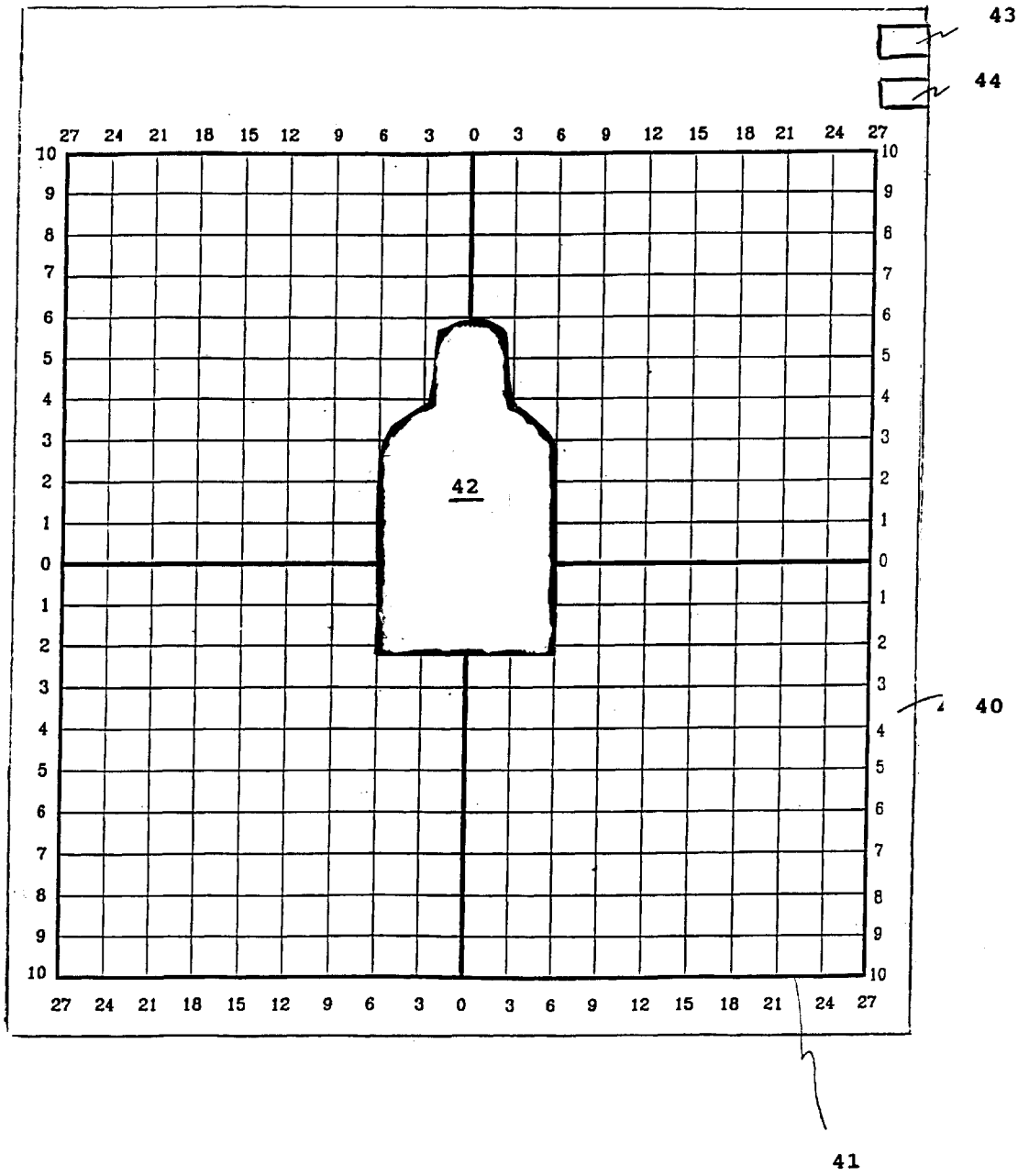
FIG. 4 is a front view of the thermal zeroing silhouette target device coupled to a 25 meter zeroing target for the M16A2 rifle.

FIG. 4 is a front view of the 25 meter thermal zeroing target (TZT) device coupled for zeroing a M16A2 rifle equipped with a TIS. Mask 40 is compressed paper board in the preferred embodiment, which includes on its face a printed target grid 41 for zeroing at 25 meters. Thermal silhouette target 42 is centered on target grid 41 with leads 22 and 23 of FIG. 2 protruding through an opening (not shown) in mask 40 for electrical connection to contacts 43 and 44. Contact 43 and 44 located at an upper corner area of mask 40 are utilized for attaching the 1.5 voltage source. The TZT is placed at a range of 25 meters and the 1.5 V dc Battery leads are attached to the TZT. An approximate wait of 1–2 minutes is made to obtain a thermal target when viewing through the TIS mounted on the M16A2 rifle at the 25 meter range. The center of mass of the heated target of the TZT is aimed at using the TIS reticle and three rounds are fired. The shot group impact points on target is then checked. If necessary, TIS reticle adjustments are adjusted and firing repeated until the shot group is aligned to the desired point of impact. For example: a 300 Meter target should have the impact points be approximately 7.3 cm below the center of mass on the TZT.

While this invention has been described in terms of preferred embodiment consisting of thermal silhouette target, those skilled in the art will recognize that the invention can be practiced with modification within the spirit and scope of the appended claims.

Having thus described my invention, what I claim as new and desire to secure by Letters Patent is as follows:

1. A thermal silhouette target for viewing by a thermal imaging sensor (TIS) comprising:

a high emissivity surface in a line of sight to a TIS, said high emissivity surface with a predetermined silhouette;

a conductive layer with said predetermined silhouette adjoining said high emissivity surface for conduction of electrical resistance heat generated by a heating coil to said high emissivity surface;

said heating coil adjoining a portion of said conductive layer for generation of electrical heat resistance to said conductive layer, said heating coil further having lead wires for electrical connection of said heating coil to a direct current voltage (DVC) source;

an insulative layer with said predetermined silhouette adjoining said heating coil and said conductive layer;

said DVC source removably coupled to said lead wires whereby when said DVC source is electrically connected to said heating coil and said high emissive surface emits thermal radiation, the TIS views said silhouette as substantially insensitive to angular adjustments of said thermal silhouette target to the TIS.

2. The thermal silhouette target of claim 1 wherein said heating coil is a ladder grid wherein said ladder grid includes sawtooth ladder portions.

3. A thermal zeroing silhouette target device for zeroing a thermal imaging sensor (TIS) mounted on a weapon comprising:

a thermal silhouette target including, a high emissivity surface in a line of sight to a TIS, said high emissivity surface with a predetermined silhouette;

a conductive layer with said predetermined silhouette adjoining said high emissivity surface for conduction of electrical resistance heat generated by a heating coil to said high emissivity surface;

said heating coil adjoining a portion of said conductive layer for generation of electrical heat resistance to said conductive layer, said heating coil further having lead wires for electrical connection of said heating coil to a direct current voltage (DVC) source;

an insulative layer with said predetermined silhouette adjoining said heating coil and said conductive layer;

a mask having a front and back surface, said front surface including thereon a zeroing grid, said zeroing grid having centrally located thereon said thermal silhouette target with said lead wires protruding from said front surface to said back surface, said lead wires electrically connected to a pair of contacts;

a pair of contacts on said mask for electrical connection to said direct voltage current said source (DVC);

a DVC source removably coupled to said pair of contacts whereby when said DVC source is electrically connected to said heating coil and said high emissive surface emits thermal radiation, the TIS views said silhouette as substantially insensitive to angular adjustments of said thermal silhouette target to the TIS so that after the mounted weapon is fired, groups of impact points are measured regarding said zeroing grid.

4. The thermal zeroing silhouette target device of claim 3 wherein said zeroing grid is a 25 meter zeroing grid.

* * * * *